US005839037A

United States Patent [19]

Larson et al.

[11] Patent Number: 5,839,037

[45] Date of Patent: Nov. 17, 1998

[54] METHOD FOR TRANSFERRING A LIQUID IMAGE

[75] Inventors: James R. Larson, Fairport; David H. Pan, Rochester; Raymond W. Stover, Webster; John S. Berkes, Webster; Christine J. Tarnawskj, Webster; Rasin Moser, Fairport, all of N.Y.

[73] Assignee: Xerox Corporation, Stamford, Conn.

[21] Appl. No.: 473,613

[22] Filed: Jun. 7, 1995

[51] Int. Cl.[6] ..... G03G 15/10

[52] U.S. Cl. ..... 399/249; 399/302

[58] Field of Search ..... 399/249, 251, 399/302, 308; 430/117–119, 126

[56] References Cited

U.S. PATENT DOCUMENTS

| | | | |
|---|---|---|---|
| 3,847,642 | 11/1974 | Rhodes . | |
| 4,684,238 | 8/1987 | Till et al. | 399/308 |
| 4,796,048 | 1/1989 | Bean | 399/308 |
| 5,132,743 | 7/1992 | Bujese et al. | 399/302 |
| 5,136,334 | 8/1992 | Camis et al. | 399/233 |
| 5,276,492 | 1/1994 | Landa et al. . | |
| 5,332,642 | 7/1994 | Simms et al. | 430/125 |
| 5,424,813 | 6/1995 | Schlueter, Jr. et al. | 399/239 |
| 5,481,341 | 1/1996 | Sypula et al. | 399/239 |
| 5,555,185 | 9/1996 | Landa | 399/308 |
| 5,570,173 | 10/1996 | Nye et al. | 399/237 |
| 5,573,883 | 11/1996 | Berkes et al. | 430/116 |

*Primary Examiner*—Robert Beatty
*Attorney, Agent, or Firm*—Lloyd F. Beam, II

[57] ABSTRACT

A method and apparatus for reproducing color images on the electrophotographic printing machine with liquid developer, wherein there is enabled with such developers in embodiments excellent fixing characteristics especially when the developed image being in two distinct liquid phases is transferred from an intermediate substrate to the final substrate, such as paper. In embodiments of the present invention there is provided developers and processes for achieving high fix. The liquid developed image is concentrated to 30 to 45 percent solid by removing carrier liquid and thereafter heated on the intermediate substrate.

6 Claims, 3 Drawing Sheets

METHOD FOR TRANSFERRING A LIQUID IMAGE

FIELD OF THE INVENTION

This invention is generally directed a method and apparatus for reproducing color images on an electrophotographic printing machine with liquid developer, wherein there is enabled with such developers excellent fixing characteristics, especially when the developed image being in two distinct liquid phases, is transferred from an intermediate substrate to a final substrate, such as paper. In embodiments of the present invention there is provided developers and processes for achieving high fix.

COPENDING APPLICATIONS

U.S. application Ser. No. 08/331,855 entitled "A FULL COLOR, HIGH SPEED PRINTING MACHINE" now U.S. Pat. No. 5,570,173 and U.S. Pat. No. 5,573,883 entitled "LIQUID DEVELOPER COMPOSITIONS" which are hereby incorporated by reference.

BACKGROUND OF THE INVENTION

It has been found that transferring a developed image in a single liquid phase or a combination of a liquid and a solid phase can result in poor or unacceptable transfer, characterized by, poor solid area coverage if insufficient toner is transferred to the final substrate and can also lead to image defects such as smears and hollowed fine features. To overcome or minimize such problems, the processes of the present invention were arrived at after extensive research efforts.

A latent electrostatic image can be developed with toner particles dispersed in an insulating nonpolar liquid. The aforementioned dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

U.S. Pat. No. 5,276,492 describes a method and apparatus for transferring liquid toner images from an image forming surface to an intermediate transfer member for subsequent transfer to a final substrate. The liquid toner images include carrier liquid and pigmented polymeric toner particles which are essentially non-soluble in the carrier liquid at room temperature, and which form a single phase at elevated temperatures. The method includes the steps of: concentrating the liquid toner image by compacting the solids portion of the liquid toner image and removing carrier liquid therefrom; transferring the liquid toner image to the intermediate transfer member, heating the liquid toner image on the intermediate transfer member to a temperature at which the toner particles and the carrier liquid form a single phase; and transferring the heated liquid toner image to a final substrate.

Useful liquid developers can comprise a thermoplastic resin, pigment, and a dispersant nonpolar liquid. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns in diameter as measured with the Horiba Capa 700 Particle Size Analyzer.

Since the formation of proper images depends, for example, on the difference of the charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,474 the disclosure of which is hereby totally incorporated herein by reference, discloses a liquid electrostatic developer comprising a nonpolar liquid, such as the Isopars, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) vinyl toluene and styrene and (iv) of butadiene and acrylate. As the copolymer of polyethylene and methacrylic acid or methacrylic acid alkyl esters, NUCREL® may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009; 5,034,299 and 5,288,508.

The disclosures of each of the U.S. Patents mentioned herein are totally incorporated herein by reference.

In U.S. Pat. No. 5,306,591 and U.S. Pat. No. 5,308,731, the disclosures of which are totally incorporated herein by reference, there is illustrated a liquid developer comprised of a nonpolar liquid, thermoplastic resin particles, a nonpolar liquid soluble ionic or zwitterionic charge director, and a charge adjuvant comprised of an aluminum hydroxycarboxylic acid, or mixtures thereof.

In U.S. Pat. No. 5,476,743, the disclosure of which is totally incorporated herein by reference, there is illustrated a liquid developer comprised of a nonpolar liquid, thermoplastic resin particles, polar organic additives with a dielectric constant in the range of about 20 to about 150, and soluble in the nonpolar liquid; and charge director. A latent electrostatic image can be developed with toner particles dispersed in an insulating nonpolar liquid. Examples of liquids illustrated in the aforementioned copending application include the ISOPAR® series (manufactured by the Exxon Corporation), the NORPAR® series available from Exxon Corporation, the SOLTROL® series available from the Phillips Petroleum Company, and the SHELLSOL® series available from the Shell Oil Company.

SUMMARY OF THE INVENTION

In accordance with one aspect of the present invention, there is provided a method for transferring a liquid developer image on an intermediate surface to a final support substrate, said liquid developer image having a liquid portion including a carrier fluid and having a solid portion including thermoplastic resin and pigment at ambient temperatures, including the steps of: heating the liquid developer image on the intermediate surface to a given temperature at least as that at which said solid portion and liquid portion form substantially two distinct liquid phases; and transferring the liquid developer image to the final support.

In accordance with another aspect of the present invention, there is provided an imaging method, including: forming an electrostatic latent image; developing the electrostatic latent image with the liquid developer having a liquid portion including a carrier fluid and having a solid portion including thermoplastic resin and pigment at ambient temperatures; transferring the developed image onto an intermediate surface; heating the developed image on the intermediate surface to a given temperature at least as that at which said solid portion and liquid portion form substantially two distinct liquid phases; and transferring the developed image to a final support.

In accordance with yet another aspect of the present invention, there is provided a printing machine, including: means for forming an electrostatic latent image on an imageable surface; means for developing the electrostatic latent image with the liquid developer having a liquid portion including a carrier fluid and having a solid portion including thermoplastic resin and pigment at ambient temperatures; means for transferring the developed image onto an intermediate member; a heater, in communication with an outer surface of said intermediate member, for heating said intermediate member to a given temperature so as to cause the solid portion and liquid portion of the developed image on the intermediate surface to form substantially two distinct liquid phases on the outer surface thereof; and means, defining a nip with the outer surface of said intermediate member, for transferring the developed image to a recording sheet passing through the nip defined by said intermediate member.

BRIEF DESCRIPTION OF THE DRAWINGS

These and other aspects of the present invention will become apparent from the following description in conjunction with the accompanying drawing in which.

DETAILED DESCRIPTION OF THE INVENTION

Figure 1:
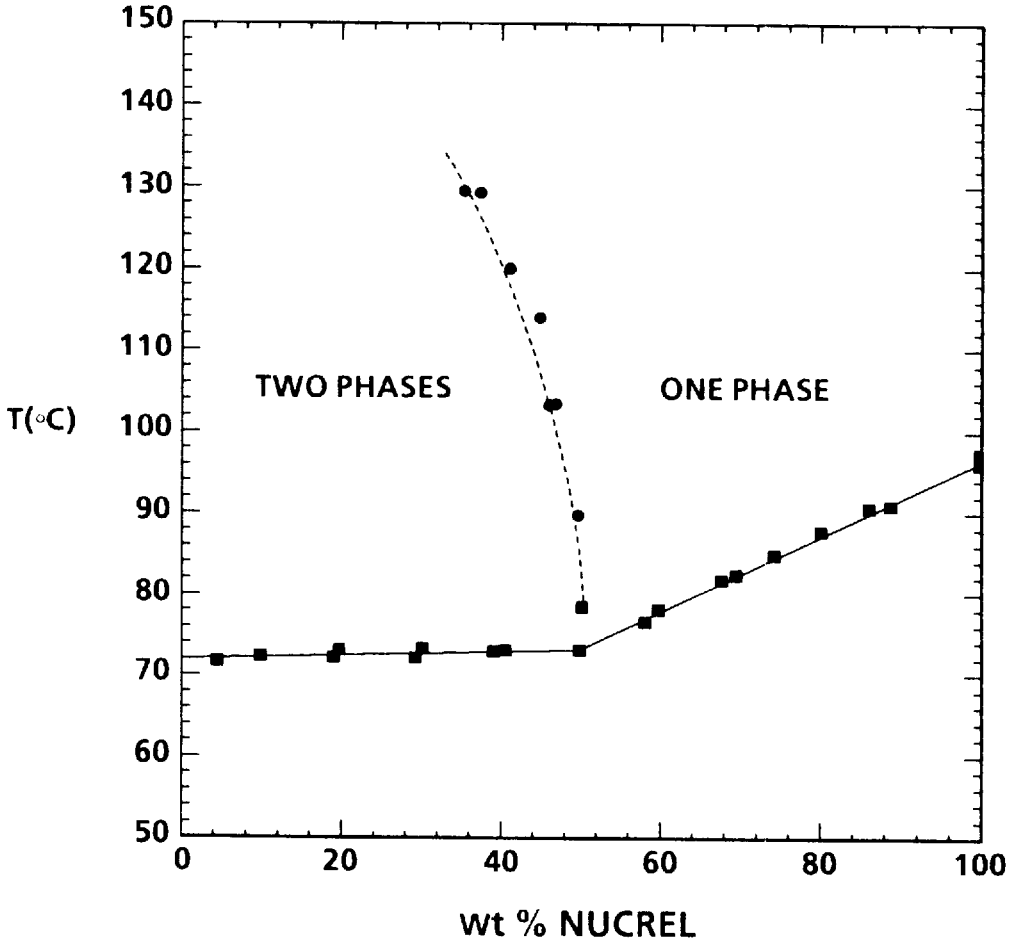
FIG. 1 is a phase diagram for a preferred liquid developer of the present invention.

The liquid developers suitable for the present invention generally comprise a liquid vehicle, toner particles, a charge control additive. The liquid medium may be any of several hydrocarbon liquids conventionally employed for liquid development processes, including hydrocarbons, such as high purity alkanes having from about 6 to about 14 carbon atoms, carrier fluids such as Norpar 15® and Isopar L® or Superla® and Isopar L® or a mixture of two or more of the above fluids.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight.

Examples of charge directors include components such as (1) a protonated AB diblock copolymer of poly[2-dimethylammoniumethyl methacrylate bromide co-2-ethylhexyl methacrylate], poly[2-dimethylammoniumethyl methacrylate tosylate co-2-ethylhexyl methacrylate], poly [2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], or poly[2-dimethylammoniumethyl methacrylate tosylate co-N,N-dibutylacrylamide]; (2) a mixture, for example 50:50, of at least two protonated AB diblock copolymers; (3) a mixture, for example 50:50, of at least one protonated AB diblock copolymer and one quarternized AB diblock copolymer, and the like. The charge directors as illustrated in the patents and copending applications mentioned herein can be selected for the developers of the present invention.

The charge director can be selected for the liquid developers in various effective amounts, such as for example in embodiments from about 0.5 percent to 80 percent by weight relative to developer solids and preferably 2 percent to 20 percent by weight relative to developer solids. Developer solids includes toner resin, pigment, and charge adjuvant. Without pigment the developer may be selected for the generation of a resist, a printing plate, and the like. Examples of other effective charge director for liquid toner particles include anionic glyceride, such as EMPHOS® D70-30C and EMPHOS® F27-85, two products sold by Witco Corporation, New York, N.Y., which are sodium salts of phosphated mono- and diglycerides with saturated and unsaturated substituents respectively, lecithin, Basic Barium Petronate, Neutral Barium Petronate, Basic Calcium Petronate, Neutral Calcium Petronate, oil soluble petroleum sulfonates, Witco Corporation, New York, N.Y., and metallic soap charge directors such as aluminum tristearate, aluminum distearate, barium, calcium, lead, and zinc stearates; cobalt, manganese, lead, and zinc lineolates, aluminum, calcium, and cobalt octoates; calcium and cobalt oleates; zinc palmitate; calcium, cobalt, manganese, lead, zinc resinates, and the like. Other effective charge directors include AB diblock copolymers of 2-ethylhexylmethacrylate-co-methacrylic acid calcium and ammonium salts.

Any suitable thermoplastic toner resin can be selected for the liquid developers of the present invention in effective amounts of, for example, in the range of about 99 percent to 40 percent of developer solids, and preferably 95 percent to 70 percent of developer solids, which developer solids includes the thermoplastic resin, optional pigment and charge control agent, and any other component that comprises the particles. Examples of such resins include ethylene vinyl acetate (EVA) copolymers (ELVAX® resins, E.I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid and at least one alkyl ester of acrylic or methacrylic acid wherein alkyl is from 1 to about 20 carbon atoms like methyl methacrylate (50 to 90 percent) /methacrylic acid (0 to 20 percent/ethylhexyl acrylate (10 to 50 percent); and other acrylic resins including ELVACITE® acrylic resins (E.I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL®, like NUCREL 599®, NUCREL 699®, or NUCREL 960® are selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant selected may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference.

To increase the toner particle charge and, accordingly, increase the mobility and transfer latitude of the toner particles, charge adjuvants can be added to the toner particles. For example, adjuvants, such as metallic soaps, like aluminum stearate, magnesium stearate or octoate, fine particle size oxides, such as oxides of silica, alumina, titania, and the like, paratoluene sulfonic acid, and polyphosphoric acid may be added. Negative charge adjuvants increase the negative charge of the toner particle, while the positive charge adjuvants increase the positive charge of the toner particles. With the invention of the present application, the adjuvants or charge additives, can be comprised of the metal catechol and aluminum hydroxy acid complexes illustrated in U.S. Pat. Nos. 5,306,590; 5,306,591 and 5,308,731, the disclosures of which are totally incorporated herein by reference, and these additives have the following advantages over the aforementioned prior art charge additives: improved toner charging characteristics, namely, an increase in particle charge, as measured by ESA mobility, of from −1.4 E-10 $m^2/Vs$ to −2.3 E-10 $m^2/Vs$, that results in improved image development and transfer, from 80 percent to 93 percent, to allow improved solid area coverage, and a transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions since the measurements can be made at high volume loadings, for example, greater than or equal to 1.5 to 10 weight percent. Measurements generated by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in the mixture of high and low vapor pressure fluids, the thermoplastic resin, charging additive, and colorant in a manner that the resulting mixture contains, for example about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; and diluting the dispersion.

In the initial mixture, the resin, colorant, and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient, liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant, and resin. However, the temperature at which this step is undertaken should not be so high as to degrade the nonpolar liquid or decompose the resin or colorant when present. Accordingly, the mixture can be heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes. After grinding at the above temperatures, an additional amount of nonpolar liquid may be added to the dispersion. The amount of nonpolar liquid to be added at this point should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of liquid developers are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. application Ser. No. 08/331,855 now U.S. Pat No. 5,570,173, the disclosure of which is totally incorporated herein by reference, the image is developed with the liquid toner illustrated herein by, for example, immersion of the photoconductor therein, followed by transfer and fixing of the image.

Figure 3:
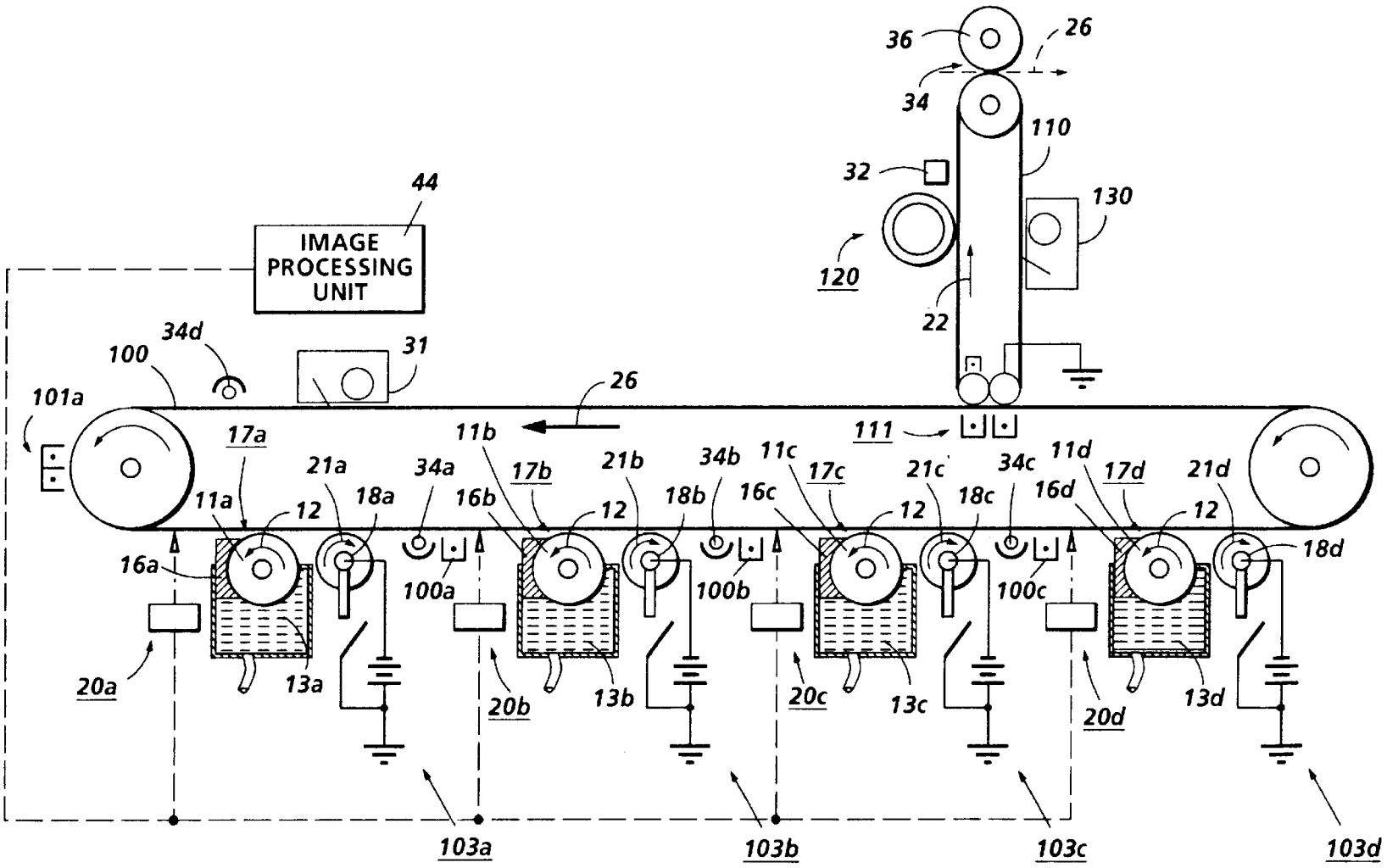
FIG. 3 is a schematic, elevational view of a color electrophotographic printing machine that employs the method of the present invention therein.

For a general understanding of the features of the present invention, reference numerals have been used throughout to designate identical elements. FIG. 3 schematically depicts the various elements of an illustrative color electrophotographic printing machine incorporating the present invention therein. It will become evident from the following discussion that the present invention is equally well suited for use in a wide variety of printing machines and is not necessarily limited in its application to the particular embodiment depicted herein.

Inasmuch as the art of electrophotographic printing is well known, the various processing stations employed in the FIG. 3 printing machine will be shown hereinafter schematically and their operation described briefly with reference thereto.

Turning now to FIG. 3, there is shown a color document imaging system incorporating the present invention. The color copy process can begin by inputting a computer generated color image into the image processing unit 44. A digital signals which represent the blue, green, and red density signals of the image are converted in the image processing unit into four bitmaps: yellow (Y), cyan (C), magenta (M), and black (Bk). The bitmap represents the value of exposure for each pixel, the color components as well as the color separation. Image processing unit 44 may contain a shading correction unit, an undercolor removal unit (UCR), a masking unit, a dithering unit, a gray level processing unit, and other imaging processing sub-systems known in the art. The image processing unit 44 can store bitmap information for subsequent images or can operate in a real time mode.

Photoconductive member 100, preferably a belt of the type which is typically multilayered and has a substrate, a conductive layer, an optional adhesive layer, an optional hole blocking layer, a charge generating layer, a charge transport layer, and, in some embodiments, an anti-curl backing layer. It is preferred that the photoconductive imaging member employed in the present invention be infrared sensitive this allows improved transmittance through a cyan image. Belt 100 is charged by charging unit 101*a*. Raster output scanner (ROS) 20*a* and similarly ROS 20*b*, 20*c* and 20*d* are controlled by image processing unit 44, ROS 20*a* writes a first complementary color image bitmap information by selectively erasing charges on the belt 100. The ROS 20*a* writes the image information pixel by pixel in a line screen registration mode. It should be noted that either discharged area development (DAD) can be employed in which discharged portions of the belt 100 are developed or charged area development (CAD) can be employed in which the charged portions are developed with toner. After the electrostatic latent image has been recorded, belt 100 is advance the electrostatic latent image to development station 103*a*. Roller 11, rotating in the direction of arrow 12, advances a liquid developer material 13*a* from the chamber of housing to development zone 17*a*. An electrode 16*a* positioned before the entrance to development zone 17*a* is electrically biased to generate an AC field just prior to the entrance to development zone 17*a* so as to disperse the toner particles substantially uniformly throughout the liquid carrier. The toner particles, disseminated through the liquid carrier, pass by electrophoresis to the electrostatic latent image. The charge of the toner particles is opposite in polarity to the charge on the photoconductive surface.

After the latent image is developed it is conditioned at development station 103*a*. Development station 103*a* also includes porous roller 18*a* having perforations through the roller skin covering. Roller 18*a* receives the developed image on belt 100 and conditions the image by reducing fluid content while inhibiting the departure of toner particles from the image, and by compacting the toner particles of the image. Thus, an increase in percent solids is provided to the developed image, thereby improving the quality of the developed image. Preferably, the percent solids in the developed image is increased to more than increased to 20 percent solids. Porous roller 18*a* operates in conjunction with vacuum (not shown) for removal of liquid from the roller. A roller (not shown), in pressure against the blotter roller 18*a*, may be used in conjunction with or in the place of the vacuum, to squeeze the absorbed liquid carrier from the blotter roller for deposit into a receptacle. Furthermore, a vacuum assisted liquid absorbing roller may also find useful application where the vacuum assisted liquid absorbing roller is in the form of a belt, whereby excess liquid carrier is absorbed through an absorbent foam layer. A belt used for collecting excess liquid from a region of liquid developed images is described in U.S. Pat. Nos. 4,299,902 and 4,258,115, the relevant portions of which are hereby incorporated by reference herein.

In operation, roller 18*a* rotates in a direction to impose against the "wet" image on belt 100. The porous body of roller 18 absorbs excess liquid from the surface of the image through the skin covering pores and perforations. The vacuum located on one end of the central cavity of the roller, draws liquid that has permeated through roller 18 out through the cavity and deposits the liquid in a receptacle or some other location which will allow for either disposal or recirculation of the liquid carrier to a replenishing system. Porous roller 18*a*, discharged of excess liquid, continues to rotate in direction 21 to provide a continuous absorption of liquid from image on belt 100. The image on belt 100 advances to lamp 34*a* where any residual charge left on the photoconductive surface is extinguished by flooding the photoconductive surface with light from lamp 34*a*.

The development takes place for the second color for example magenta, as follows: the developed latent image on belt 100 is recharged with charging unit 100*b*. The developed latent image is re-exposed by ROS 20*b*. ROS 20*b* superimposes a second color image bitmap information over the previous developed latent image. At development station B, roller 116, rotating in the direction of arrow 12, advances a liquid developer material 13 from the chamber of housing to development zone 17*b*. An electrode 16*b* positioned before the entrance to development zone 17*b* is electrically biased to generate an AC field just prior to the entrance to development zone 17*b* so as to disperse the toner particles substantially uniformly throughout the liquid carrier. The toner particles, disseminated through the liquid carrier, pass by electrophoresis to the previous developed image. The charge of the toner particles is opposite in polarity to the charge on the previous developed image. Roller 18*b* receives the developed image on belt 100 and conditions the image by reducing fluid content while inhibiting the departure of toner particles from the image, and by compacting the toner particles of the image. Preferably, the percent solids is more than 20 percent, however, the percent of solids can range between 15 percent and 40 percent. The image on belt 100 advances to lamps 34*b* where any residual charge left on the photoconductive surface is extinguished by flooding the photoconductive surface with light from lamp 34.

Development takes place for the third color and fourth color, for example cyan and black in the same manner as described above, with the steps of charging, exposing, developing and conditioning for each color developed.

The resultant image, a multi layer image by virtue of the developing station 103*a*, 103*b*, 103*c* and 103*d* having black, yellow, magenta, and cyan, toner disposed therein advances to the intermediate transfer station. It should be evident to one skilled in the art that the color of toner at each development station could be in a different arrangement. The resultant image is electrostatically transferred to the intermediate member by charging device 111. The present invention takes advantage of the dimensional stability of the intermediate member to provide a uniform image deposition stage, resulting in a controlled image transfer gap and better image registration. Further advantages include reduced heating of the recording sheet as a result of the toner or marking particles being pre-melted, as well as the elimination of electrostatic transfer of charged particles to a recording sheet. Intermediate member 110 may be either a rigid roll or an endless belt having a path defined by a plurality of rollers in contact with the inner surface thereof. The multi layer image is conditioned by blotter roller 120 which receives the multi level image on intermediate member 110 and conditions the image by reducing fluid content while inhibiting the departure of toner particles from the image, and by compacting the toner particles of the image. Blotter roller 120 conditions the multi layer so that the image has a toner composition of 30 to 45 percent solids.

Subsequently, the multi layer image, present on the surface of the intermediate member, is advanced through image transfer stage B. Within stage B, which essentially encompasses the region between when the multi layer image contact the surface of member 110 and when the multi layer is transferred to recording sheet 26. Stage B includes a heating element 32 to heat the multi layer image prior to transfer.

Referring to FIG. 1 which illustrates a phase diagram of Isopar M/Nucrel 599, a single phase can form at concentrations greater than about 50 percent Nucrel 599 and a temperature higher than the melting point. Accordingly, images of 50 percent solids are near the liquid-liquid phase separation boundary at which phase instability may occur. In the present invention it is preferred that the multi layer image has composition of between 30 to 45 percent solids and is heated between 80° to 110° C. This causes two distinct liquid phases to form. A nearly pure carrier phase (called the minor phase) and a liquid phase containing about 50 percent toner resin (called the major phase). At transfix nip 34, the liquefied toner particles are forced by a normal force N applied through backup pressure roll 36, into contact with the surface of recording sheet 26. The normal force N, produces a nip pressure which is preferably about 100 to 200 psi, and may also be applied to the recording sheet via a resilient blade or similar spring-like member uniformly biased against the outer surface of the intermediate member across its width.

An advantageous feature of the present invention under transfix conditions in which there are two distinct phases it is believed that the predominantly pure carrier fluid (the minor phase) kinetically encapsulates the toner resin (major phase) and separates from the image at the transfix nip thereby improving release of carrier fluid from the image.

As the recording sheet passes through the transfix nip the tackified toner particles wet the surface of the recording sheet, and due to greater attractive forces between the paper and the tackified particles, as compared to the attraction between the tackified particles and the liquid-phobic surface of member 110, the tackified particles are completely transferred to the recording sheet. Furthermore, as the image is transferred to recording sheet 26 in a tackified state, the image become permanent once they are advanced past transfix nip and allowed to cool.

After the developed image is transferred to intermediate member 110, residual liquid developer material remains adhering to the photoconductive surface of belt 100. A cleaning roller 31 formed of any appropriate synthetic resin, is driven in a direction opposite to the direction of movement of belt 100 to scrub the photoconductive surface clean. It is understood, however, that a number of photoconductor cleaning means exist in the art, any of which would be suitable for use with the present invention. Any residual charge left on the photoconductive surface is extinguished by flooding the photoconductive surface with light from lamp 34*d*.

Specific embodiments of the invention will now be described in detail. These Examples are intended to be illustrative, and the invention is not limited to the materials, conditions, or process parameters set forth in these embodiments. All parts and percentages are by weight unless otherwise indicated. Comparative Examples are also provided.

EXAMPLE 1

MAGENTA LIQUID TONER CONCENTRATE

One hundred and sixty five and three tenths (165.3) grams of NUCREL 599® (a copolymer of ethylene and methacrylic acid with a melt index at 190° C. of 500 dg/minute, available from E.I. DuPont de Nemours & Company, Wilmington, Del.), 56.8 grams of the magenta pigment FANAL PINK™, 5.1 grams of aluminum stearate WITCO 22™ (Witco) and 307.4 grams of NORPAR 15®, carbon chain of 15 average (Exxon Corporation), were added to a Union Process 1S attritor (Union Process Company, Akron, Ohio) charged with 0.1875 inch (4.76 millimeters) diameter carbon steel balls. The mixture was milled at 125 rpm in the attritor which was heated to 83° C. to 96° C. for 2 hours by running steam through the attritor jacket and then an additional 980.1 grams of NORPAR 15® were added to the attritor and the attritor contents were cooled to 23° C. over 4 hours at a stir rate of 200 rpm by running cold water through the attritor jacket. An additional 1,532 grams of NORPAR 15® were added, and the mixture was separated by the use of a metal grate from the steel balls yielding a liquid toner concentrate of 7.19 percent solids wherein solids include resin, charge adjuvant, and pigment and 92.81 percent NORPAR 15®. The particle diameter was 2.02 microns average by area as measured with the Horiba Cappa 500. This toner concentrate was used to prepare developers of Controls and in Examples.

EXAMPLE 2

BASE POLYMER PREPARATION 1

Sequential Group Transfer Polymerization (GTP) of 2-Ethylhexyl Methacrylate (EHMA) and 2-Dimethylaminoethyl Methacrylate (DMAEMA) to Prepare the AB Diblock Copolymer Precursor of Protonated Ammonium or Quaternary Ammonium Block Copolymer Charge Directors.

AB diblock copolymer precursors were prepared by a standard group transfer sequential polymerization procedure (GTP) wherein the ethylhexyl methacrylate monomer was first polymerized to completion and then the 2-dimethylaminoethyl methacrylate monomer was polymerized onto the living end of the ethylhexyl methacrylate polymer. All glassware was first baked out in an air convection oven at about 120° C. for about 16–18 hours.

In a typical procedure, a 2 liter 3-neck round bottom flask equipped with a magnetic stirring football, an Argon inlet and outlet and a neutral alumina (150 grams) column (later to be replaced by a rubber septum and then a liquid dropping funnel) is charged through the alumina column, which is maintained under a positive Argon flow and sealed from the atmosphere, with 415 grams (2.093 mole) of freshly distilled 2-ethylhexyl methacrylate (EHMA) monomer. Next 500 ml of freshly distilled tetrahydrofuran solvent, distilled from sodium benzophenone, is rinsed through the same alumina column into the polymerization vessel. Subsequently, the GTP initiator, 15 ml of methyl trimethylsilyl dimethylketene acetal (12.87 grams; 0.0738 mole) is syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.1 ml of a 0.66M solution of tetrabutylammonium acetate (catalyst) in the same dry tetrahydrofuran was syringed into the polymerization vessel. After an additional hour stirring under Argon, the polymerization temperature peaked at about 50° C. Shortly thereafter, 90 grams (0.572 mole) of freshly distilled 2-dimethylaminoethyl methacrylate (DMAEMA) monomer was dropwise added to the polymerization vessel. The polymerization solution was stirred under Argon for at least 4 hours after the temperature peaked. Then 5 ml of methanol was added to quench the live ends of the fully grown copolymer. The above charges of initiator and monomers provide an Mn and average degree of polymerization (DP) for each block. For the EHMA non-polar B block, the charged Mn is 5,621 and the DP is 28.3 and for the DMAEMA polar A block, the charged Mn is 1,219 and the DP is 7.8. $^1$H-NMR analysis of a 20% (g/dl) $CDCl_3$ solution of the copolymer indicated a 77 to 78 mole percent EHMA content and a 22 to 23 mole percent DMAEMA content. GPC analysis was obtained on a fraction of the 1–2 gram sample of isolated polymer using three 250×8 mm Phenomenex Phenogel ™ columns in series (100, 500, 1000 Angstrom) onto which was injected a 10 microliter sample of the block copolymer at 1% (wt/vol) in THF. The sample was eluted with THF at a flow rate of 1 ml/min and the chromatogram was detected with a 254 nm UV detector. The GPC chromatogram was bimodal with the major peak occurring at 13.4–22.2 counts and the minor low molecular weight peak at 23.5–28.3 counts. The major peak has a polystyrene equivalent number average molecular weight (Mn) of 2346 and a weight average molecular weight (Mw) of 8398 (MWD=3.58).

A small (1–2 grams) portion of the AB diblock copolymer can be isolated for GPC and $^1$H-NMR analyses by precipitation into 10× its solution volume of methanol using vigorous mechanical agitation. The precipitated copolymer was then washed on the funnel with more methanol and was then dried overnight in vacuo (about 0.5 Torr) at about 50° C.

EXAMPLE 3

BASE POLYMER PREPARATION 2

A second AB diblock copolymer was prepared as described in Example 2 using the same polymerization procedure, conditions, and quantities of the same materials except that more ketene acetal was used to initiate this GTP. In this preparation, 26 ml of the ketene acetal (22.31 grams; 0.1280 mole) were used to initiate the polymerization. The above monomer charges are equivalent to 78.5 mole percent EHMA and 21.5 mole percent DMAEMA which corresponds to an EHMA average DP of 16.4 (Mn of 3243) and a DMAEMA average DP of 4.5 (Mn of 703). After solvent exchange as described above in Example 2, a 1–2 gram sample of the AB diblock copolymer was isolated by evaporating the toluene in a vacuum oven overnight at about 55° C. and 0.5 Torr and the dried AB diblock copolymer was next sampled for $^1$H-NMR analysis. $^1$H-NMR analysis of a 20% (g/dl) $CDCl_3$ solution of the AB diblock copolymer indicated about a 79 to 80 mole percent EHMA repeat unit content and a 20 to 21 mole percent DMAEMA repeat unit content. GPC analysis, as described in Example 2, indicated the major peak at 14.5 to 19.9 counts to have a number average molecular weight of 3,912 and a weight average molecular weight of 6,222 (MWD of 1.59). Two barely discernible broad low molecular weight peaks were located at 20–25.1 and 25.1–30 counts.

EXAMPLE 4

BASE POLYMER PREPARATION 3

A third AB diblock copolymer was prepared as described in Example 3 using the same polymerization procedure and conditions except the polymerization scale was increased by a factor of three. $^1$H-NMR analysis of a 17.5% (g/dl) $CDCl_3$ solution of an isolated portion of the unprotonated block copolymer indicated about a 77 to 78 mole percent EHMA repeat unit content and a 22 to 23 mole percent DMAEMA repeat unit content. GPC analysis of this unprotonated block copolymer, as described in Example 2, indicated the major peak at 14.4–22.6 counts to have a number average molecular weight of 2253 and a weight average molecular weight of 5978 (MWD of 2.65). A broad low molecular weight peak was located at 24–32 counts. A hydrogen bromide protonated charge director was prepared from this AB diblock copolymer solution in toluene as described in Example 5.

EXAMPLE 5

CHARGE DIRECTOR PREPARATION FROM BASE POLYMER PREPARATION 3

Preparation of the hydrogen bromide ammonium salt AB diblock copolymer charge director, poly[2-ethylhexyl methacrylate (B block)-co-N,N-dimethyl-N-ethyl methacrylate ammonium bromide (A block)], from poly [2-ethylhexyl methacrylate (B block)-co-N,N-dimethylamino-N-ethyl methacrylate (A block)] prepared in Example 4 and aqueous hydrogen bromide:

To a 1 liter Erlenmeyer flask was added 294.93 grams of a 50.86 weight percent toluene solution of an AB diblock copolymer (150 grams) from poly (2-ethylhexyl methacrylate-co-N,N-dimethylamino-N-ethyl methacrylate) prepared in Example 4 comprised of 18.23 weight percent 2-dimethylaminoethyl methacrylate (DMAEMA) repeat units and 81.77 weight percent 2ethylhexyl methacrylate (EHMA) repeat units. The 150 grams of AB diblock copolymer contains 27.35 grams (0.174 mole) of DMAEMA repeat units. To this magnetically stirred AB diblock copolymer toluene solution at about 20° C. was added 28.73 grams (0.170 mole of HBr) of 48% aqueous hydrobromic acid (Aldrich). The charged aqueous hydrobromic acid targeted 98.0 mole percent of the available DMAEMA repeat units in the AB diblock copolymer. A 2° C. exotherm was observed in the first 5 minutes, but after the addition of 23.4 grams of methanol, an 8° C. exotherm was observed in the next five minutes and then the temperature of the contents of the reaction vessel slowly began to drop. To reduce the viscosity of the reaction mixture, 150 grams additional toluene was added to give a 33 weight percent solids solution of moderate viscosity. This solution was magnetically stirred for 20 hours at ambient temperature and was then diluted with Norpar 15 (2850 grams) to give a 5 weight % (based on the corresponding starting weight of the AB diblock copolymer from Example 4) charge director solution after toluene and methanol rotoevaporation. Toluene and methanol were rotoevaporated at 50°–60° C. for 1–2 hours at 40–50 mm Hg from 500–600 ml portions of the charge director solution until the entire sample was rotoevaporated. The 5 weight % Norpar 15 solution of poly(2-ethylhexyl methacrylate-co-N, N-dimethyl-N-ethyl methacrylate ammonium bromide) had a conductivity of 1700 to 1735 pmhos/cm and was used to charge liquid toner concentrate prepared in Example 1 to give a megenta liquid developer as described in Example 6.

EXAMPLE 6

MAGENTA LIQUID DEVELOPER CHARGED WITH POLY[2-ETHYLHEXYL METHACRYLATE (B BLOCK)-CO-N,N-DIMETHYL-N-ETHYL METHACRYLATE AMMONIUM BROMIDE (A BLOCK)]

Figure 2:
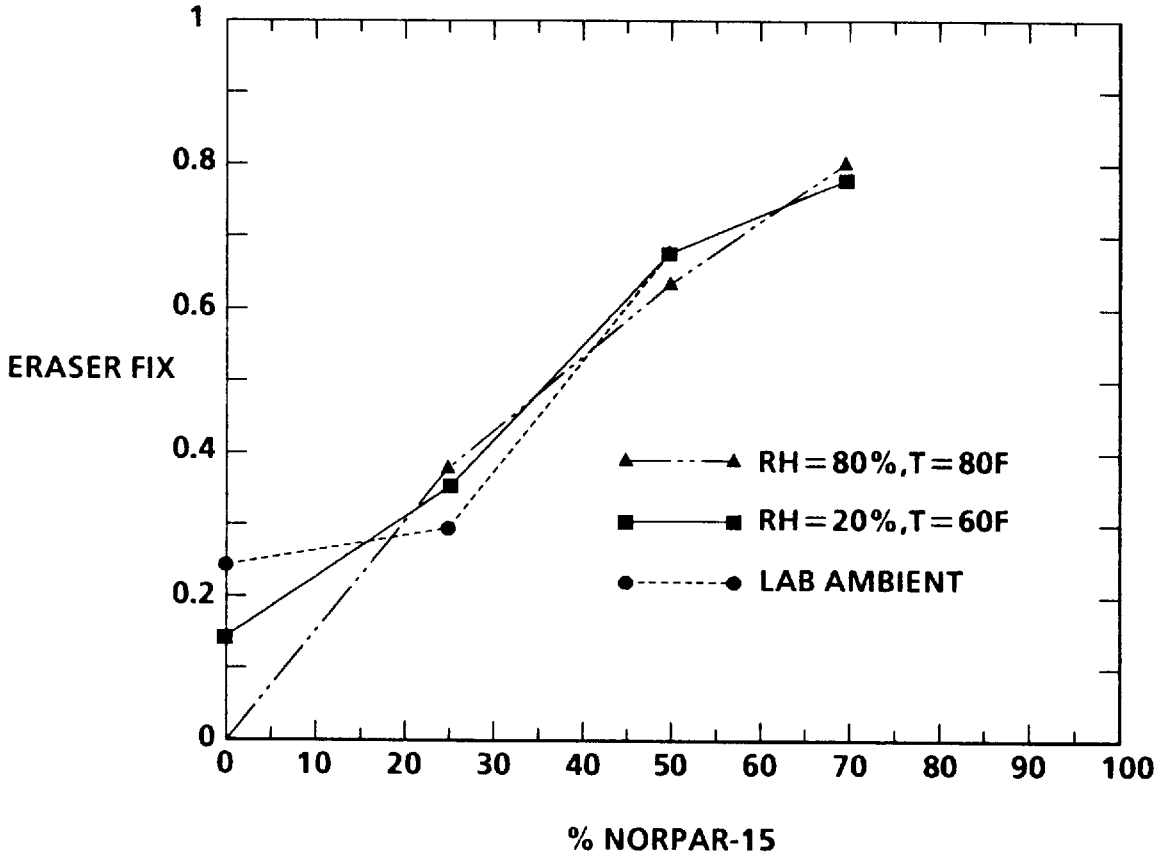
FIG. 2 illustrates experimental data in which shows fix by Eraser test verses percent Norpar 15.

A magenta liquid toner dispersion (developer) was prepared by taking liquid toner concentrate (6.74% solids in Norpar 15 with the ink solids being thermoplastic resin, pigment, and charge adjuvant) from Example 1 and adding to Norpar 15, and charge director (5% solids in Norpar 15) from Example 5. This magenta developer was then used the following data was obtained as shown in FIG. 2:

Test images consisting of solid patches with known percent solids concentrations prepared on paper. The patches were eraser fix tested by initially taking the optical density of each patch; rubbing the patch with a pink pearl eraser; and taking a final optical density. FIG. 2 illustrates fix by Eraser test verses percent Norpar 15 with the intermediate heated to 100° C. The eraser test was preformed under various environmental conditions as illustrated on FIG. 2.

From each of these Examples, It was found that good fix and smear levels were obtained once the solids level exceeds 30% and below 45% and the temperature was between 80° to 110° C.

It is, therefore, evident that there has been provided, in accordance with the present invention, a method for transferring a liquid image that fully satisfies the aims and advantages hereinbefore set forth. While this invention has been described in conjunction with one embodiment thereof, it is evident that many alternatives, modifications and variations will be apparent to those skilled in the art. Accordingly, it is intended to embrace all such alternatives, modification and variations as fall within the spirit and broad scope of the appended claims.

What is claimed is:

1. A method for transferring a liquid developer image on an intermediate surface to a final support substrate, said liquid developer image having a liquid portion including a carrier fluid and having a solid portion including thermoplastic resin and pigment at ambient temperatures, comprising the steps of:

heating the liquid developer image on the intermediate surface to a given temperature at least such that said solid portion and liquid portion form substantially two distinct liquid phases;

transferring the liquid developer image to the final support; and concentrating the liquid developer image, before said heating step, to a given solid percentage by compacting the solids portion thereof and removing carrier liquid therefrom such that the solid portion and the liquid portion form substantially two phases at said given temperature and wherein said solid percentage ranges from 30 to 45 percent solids.

2. The method of claim 1, wherein said given temperature ranges from 80° to 110° C.

3. An imaging method, comprising:

forming an electrostatic latent image;

developing the electrostatic latent image with the liquid developer having a liquid portion including a carrier fluid and having a solid portion including thermoplastic resin and pigment at ambient temperatures;

transferring the developed image onto an intermediate surface;

heating the developed image on the intermediate surface to a given temperature at least such that said solid portion and liquid portion form substantially two distinct liquid phases transferring the developed image to a final support; and concentrating the developed image, before said heating step, to a given solid percentage by compacting the solids portion thereof and removing carrier liquid therefrom such that the solid portion and the liquid portion form substantially two phases at said given temperature and wherein said solid percentage ranges from 30 to 45 percent solids.

4. The method of claim 3, wherein said given temperature ranges from 80° to 110° C.

5. A printing machine, comprising:

means for forming an electrostatic latent image on an imageable surface;

means for developing the electrostatic latent image with liquid developer having a liquid portion including a carrier fluid and having a solid portion including thermoplastic resin and pigment at ambient temperatures;

means for transferring the developed image onto an intermediate member;

a heater, in communication with an outer surface of said intermediate member, for heating said intermediate member to a given temperature so as to cause the solid portion and liquid portion of the developed image on the intermediate surface to form substantially two distinct liquid phases on the outer surface thereof;

mean, defining a nip with the outer surface of said intermediate member, for transferring the developed image to a recording sheet passing through the nip defined by said intermediate member; and means for conditioning the developed image to a given solid percentage by reducing liquid portion while inhibiting the departure of the solid portion therefrom thereby increasing solids content of the developed image on said intermediate member such that the solid portion and the liquid portion form substantially two phases at said given temperature and wherein said solid percentage ranges from 30 to 45 percent solids.

6. The printing machine of claim 5, wherein said given temperature ranges from 80° to 110° C.

* * * * *